US005080224A

United States Patent [19]

Kuhn et al.

[11] Patent Number: 5,080,224

[45] Date of Patent: Jan. 14, 1992

[54] PACK MADE FROM BOARD OF A SIMILAR MATERIAL

[75] Inventors: Werner Kuhn, Buchenberg; Walter Schragle, Kempten; Walter Ramspott; Birgit Degeler, both of Kempten, all of Fed. Rep. of Germany

[73] Assignee: Lever Brothers Company, Division of Conopco, Inc., New York, N.Y.

[21] Appl. No.: 524,611

[22] Filed: May 17, 1990

[51] Int. Cl.[5] ..... B65B 71/06

[52] U.S. Cl. ..... 206/144; 206/434; 229/125.28

[58] Field of Search ..... 206/434, 431, 427, 144, 206/446; 229/125.28

[56] References Cited

U.S. PATENT DOCUMENTS

| | | | |
|---|---|---|---|
| 2,511,550 | 6/1950 | Simms | 229/125.28 X |
| 3,245,527 | 4/1966 | Martin | 206/427 |
| 3,337,116 | 8/1967 | Nowak | 229/125.28 |
| 3,895,713 | 7/1975 | Bunnell | 206/427 |
| 4,004,692 | 1/1977 | Burns | 229/125.28 X |
| 4,286,709 | 9/1981 | Manizza | 206/144 |
| 4,471,870 | 9/1984 | Uhlig | 206/427 X |
| 4,625,864 | 12/1986 | Nigrelli | 206/427 |
| 4,821,874 | 4/1989 | Uhlig | 206/434 X |

*Primary Examiner*—Paul T. Sewell
*Assistant Examiner*—Jacob K. Ackon, Jr.
*Attorney, Agent, or Firm*—Ronald A. Koatz

[57] ABSTRACT

Pack made from board or a similar material for several bottle-like containers arranged behind each other in at least one row, consisting of a tray-like base section, which is folded from a flat board blank and in which the containers stand, and a top section that covers the containers.

6 Claims, 4 Drawing Sheets

PACK MADE FROM BOARD OF A SIMILAR MATERIAL

DESCRIPTION

Figure 1:
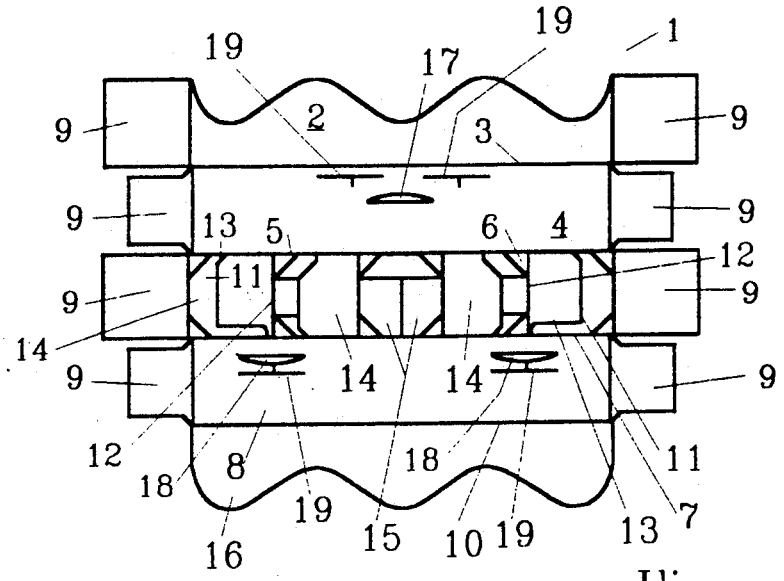

The invention relates to a pack made from board or a similar material for several bottle-like containers arranged behind each other in at least one row.

Numerous packs of this kind have been disclosed in practice, some of which surround the containers tightly as a sleeve, holding them in place securely. These packs have to be destroyed to remove the containers, however, which is generally a very laborious and time-consuming process.

Another kind of pack in common use is the open tray, in which the containers are placed from above and from which they are easy to remove. They are not, however, held in place at all securely.

The purpose of the present invention is to design a pack of the kind outlined above in such a way that the containers are held in place very securely but are still easy to remove.

In the solution to this problem proposed by the invention, a tray-like base section that is folded from a flat board blank is provided, in which the containers stand that are covered by a top section which is also made from a flat board blank and has curved or wave-shaped cut-out sections that engage cuts in the base section and lock the two sections together. In this way a sufficiently stable pack is created which provides the containers it holds with very good protection for transport from the producer to the retailer in particular. The pack is, however, very easy to open and then represents a very effective retail tray which also supports the containers reliably on the supermarkt shelf without making them difficult to remove.

In an advantageous further development of the invention, T-shaped cuts, which are engaged by curved projections in the top section, are provided in the side panels of the base section.

The mutual locking of the top section and the base section is improved even more as a result.

It is also very advantageous if in accordance with the invention the tray-like base section has a base panel section to which a side panel is hinged (via a folding line), which is in turn hinged to a top panel which is connected to a further side panel by a folding line and if flaps, which form the end panels of the base section, are hinged to the free edges of these panels and if a further base panel section, which is glued or sealed to the first base panel section when the base section is erected, is hinged to the side panel.

In this way a base section is created that is very stable in itself, maintains its inherent stiffness even after the top section has been removed and holds the containers securely in position.

In a further advantageous development of the invention, the top section has a top panel that rests on the containers, a side panel, which is provided with at least one extension that overlaps the corresponding side panel of the base section to at least some extent, being hinged to each side of this top panel. This top section is attached to the base section very securely, but is very easy to remove from the same because it is attached so simply.

In a further advantageous development of the invention, one side panel of the top section is provided with two curved sections located a distance apart and the other side panel is provided with a wave-shaped section to engage the base section at two points, while the base section has appropriate cuts to accommodate these sections.

The top section is as a result attached even more securely to the base section and thus holds the containers in position more effectively as well.

The top section and the bottom section are attached particularly stably in accordance with the invention if at least one of the two side panels of the top section is provided with two extensions located a distance apart.

In a very simple version of the pack for two rows of containers it is provided in accordance with the invention that two base sections are located next to each other, the adjacent side panels of which are glued together, and that the top panel of the top section resting on the containers is as wide as two rows of containers.

Two embodiments of the invention are illustrated in the drawings.

Figure 2:
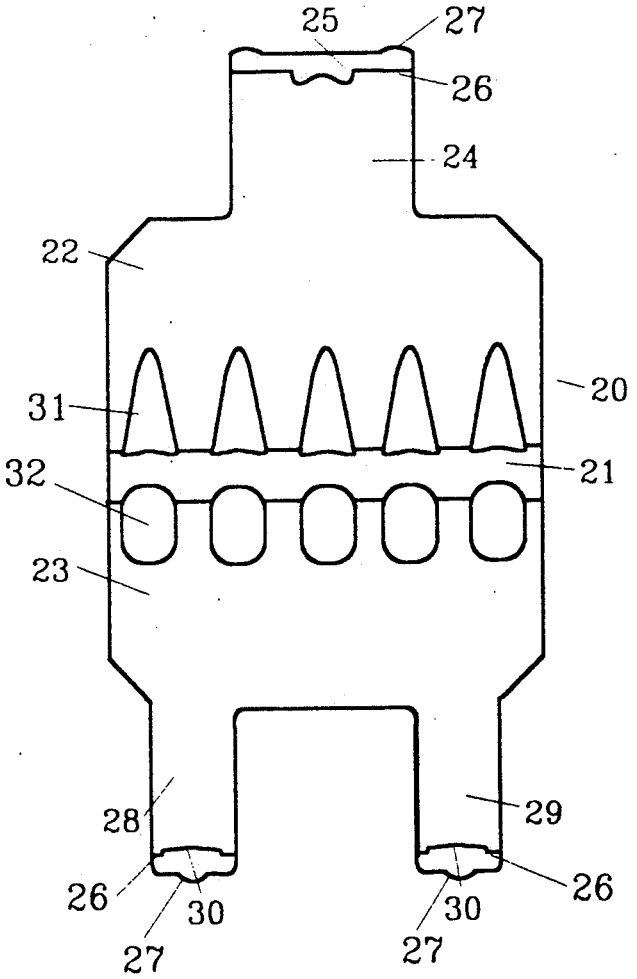
Figure 3:
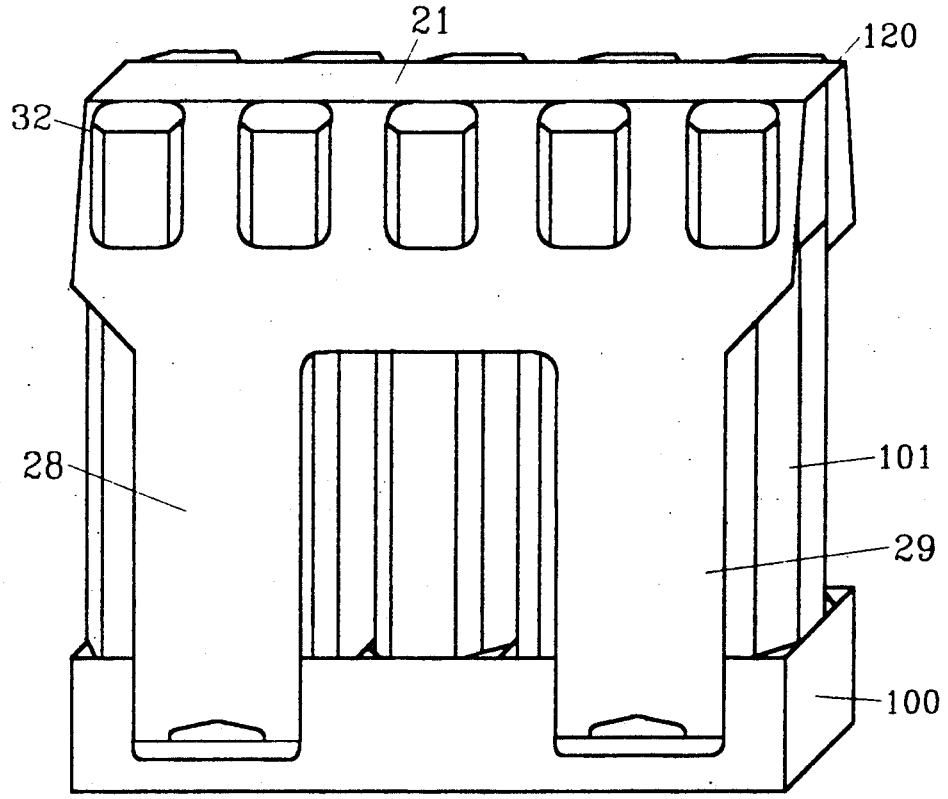
Figure 5:
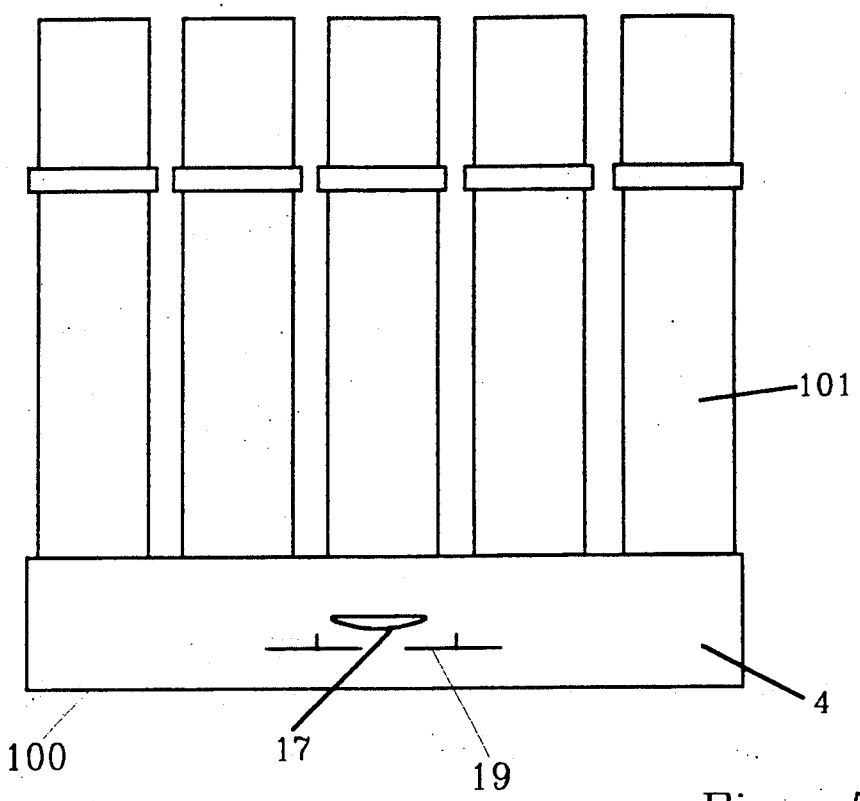
Figure 4:
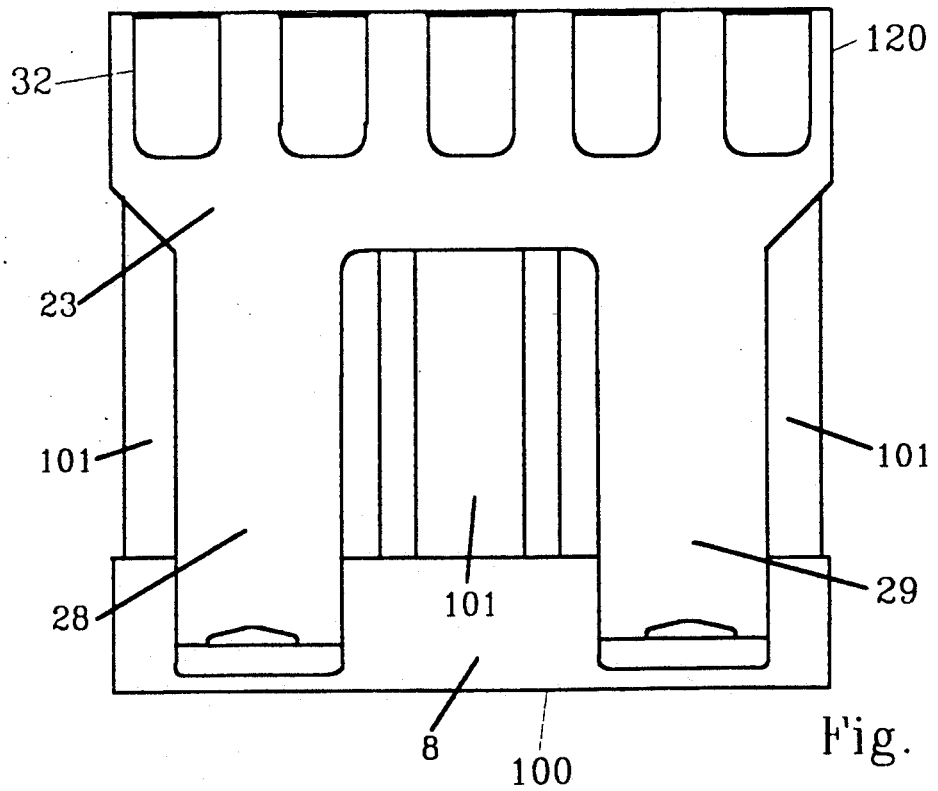
Figure 6:
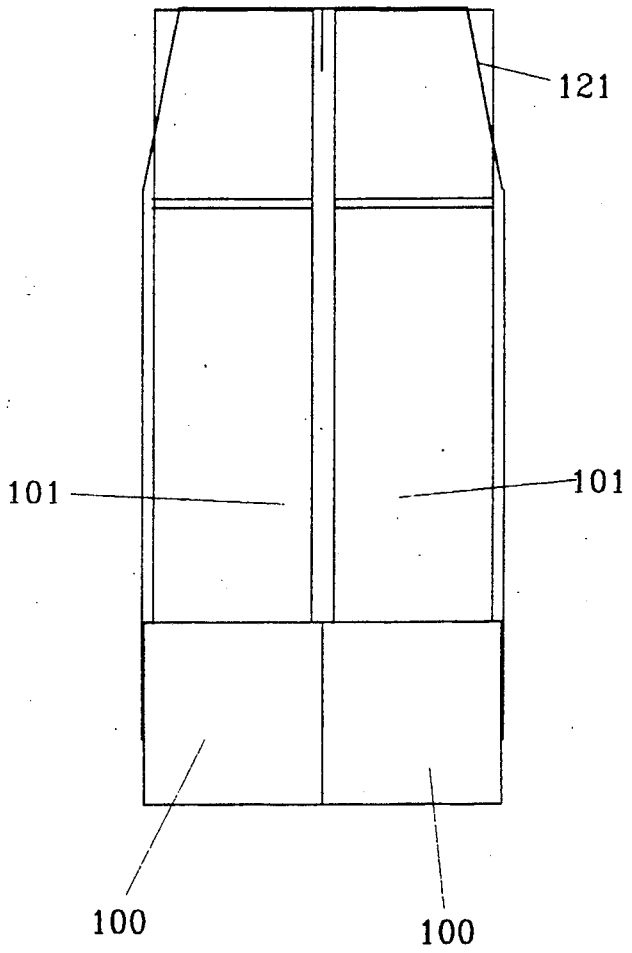

FIG. 1 shows a flat board blank, from which the base section of the pack can be produced, FIG. 2 shows a flat board blank, with which the top section of the pack can be erected, FIG. 3 shows a finished pack after it has been erected and filled, FIG. 4 is a side view of this pack, FIG. 5 shows the same pack with the top section removed and FIG. 6 is an end view of a pack with two rows of containers next to each other.

1 in FIG. 1 is a flat board blank which has a base panel section 2, to which a side panel 4 is hinged along a folding line 3. A top panel 6, to which a further side panel 8 is connected via a folding line 7, is hinged to this side panel 4 along a further folding line 5. Flaps 9 of varying sizes, which overlap to form the end panels of the base section, are hinged to the free edges of these four panels 2, 4, 6, 8. The top panel 6 is provided with cut lines 11 and crease lines 12, which form tabs 13, 14 and 15 that are folded downwards and rest to some extent against the base panel and the side panels. This gives the top panel and thus the whole of the base section a high degree of stiffness/torsion resistance. A further base panel section 16, which is glued or sealed to the other base panel section 2 when the base section is erected, is hinged to the side panel 8 via a folding line 10. The two side panels 4 and 8 are provided with cuts 17 and 18 and T-shaped cuts 19, in which the top section of the pack is secured. The horizontal section of the T-shaped cuts 19 extends parallel to the adjacent folding line 3/10, in which cuts are also provided in the area of the T-shaped cuts, so that the base section can be folded properly without affecting the T-shaped cuts.

The top section of the pack is also produced from a flat board blank 20, which has a top panel 21, to each side of which a side panel 22, 23 is hinged. One side panel 22 is provided with an extension 24, from which a wave-shaped section 25 is cut, which interrupts a folding line 26. The free end of this extension 24 is provided with two curved projections 27. The other side panel 23 is provided with two extension 28 and 29, both of which have a curved section 30, which interrupts a folding line 26. The free ends of these two extensions again have curved projections 27. Standard openings 31, which allow the top section to adapt to container tolerances, are provided at the transition point between the top panel 21 and side panel 22 and between top panel 21 and side panel 23, respectively. Holes 32, through which the individual packaged containers can be seen and their price labels applied, are also cut out of the side panels 22/23.

When the complete pack is produced, the base section is erected and closed, the containers are inserted and then the top section is folded over the containers. The extensions 24, 28, 29 are placed against the base section and the wave-shaped and curved sections 25, 30 are inserted in the appropriate cuts 17 and 18. The curved projections 27 are at the same time pressed into the T-shaped cuts 19, as a result of which the projections are secured very effectively in the base section.

In the embodiment shown in FIG. 3 and 4, the extensions 24, 28, 29 are longer, but this does not have any effect on the function. The blank 1 has been erected into a tray-like base section 100 and five containers 101 in the form of bottles have been placed in the openings formed in the top panel and are held by the top section 120.

In FIG. 5 the top section has been removed from the pack. This is done simply by pulling the sections 25, 30 out of the relevant cuts 17, 18 and the curved projections 27 out of the T-shaped cuts 19.

In the embodiment shown in FIG. 6, two tray-like sections 100 are located next to each other and their adjacent side panels are glued together. In this way a two-row pack is created, the containers 101 in which are held in position by an appropriately designed top section 121 with a wider top panel.

We claim:

1. Pack made from board and which pack is designed to hold several bottle-like containers arranged behind each other in at least one row, wherein said pack comprises:

(1) a tray-like base section that is folded from a flat board blank and which accommodates only a small proportion of the height of the container which container rests on the base and which container can be removed upwardly from the base; and (2) a top section designed to cover the container which top section is also made from a flat board blank;

said top section having curved and or wave-shaped cut-out sections that engage cuts in the base section and which lock the base and top sections together so that the containers are held securely in the base section.

2. Pack according to claim 1 wherein the tray-like base section comprises a base panel section (2) hinged to a side panel (4), which side panel is in turn hinged to a top panel (6), which top panel is connected to a further side panel (8) by a folding line (7) and wherein flaps (9) of differing sizes, which flaps form the end panels of the base section, are hinged to the free edges of these panels and wherein a further base panel section (16), which further base panel section is glued or sealed to the first base panel section (2) when the base section is erected, is hinged to further side panel (8).

3. Pack according to claim 1, wherein the top section has a top panel (21) that rests on the containers (101), a side panel (22, 23), which is provided with at least one extension (24, 28, 29) that overlaps the corresponding side panel (4, 8) of the base section to at least some extent, being hinged to each side of this top panel (21).

4. Pack according to claim 1, wherein one side panel (23) of the top section comprises two extensions (28, 29) of the side panel which extensions are located a distance apart, each of which extensions comprises a curved section (30) at the end; and wherein the other side panel (22) comprises a wave-shaped section (25) at the end;

wherein the base section has appropriate cuts designed to accommodate the two curved sections (30) and the wave-shaped section.

5. Pack according to claim 1, wherein two base sections (100) are located next to each other, the adjacent side panels (4, 8) of which are glued together, and wherein the top panel (21) of the top section resting on the containers (101) is as wide as two rows of containers.

6. Pack according to claim 4 wherein the side panels (2, 8) of the base section comprise, in addition to cuts 17 and 18, T-shaped cuts (19); wherein side panel 22 of the top section comprises curved projections 27; and wherein the curved projections 27 in the top section are designed to engage the T-shaped cuts of the base section.

* * * * *